US005555743A

United States Patent [19]

Hatanaka

[11] Patent Number: 5,555,743

[45] Date of Patent: Sep. 17, 1996

[54] APPARATUS FOR WATER SUPPLY OF AUTOMATIC ICE MAKING APPARATUS

[75] Inventor: Hideharu Hatanaka, Osaka-fu, Japan

[73] Assignee: Kabushiki Kaisha Toshiba, Japan

[21] Appl. No.: 380,992

[22] Filed: Jan. 31, 1995

[30] Foreign Application Priority Data

Jan. 31, 1994 [JP] Japan ..... 6-009173

[51] Int. Cl.[6] ..... F25C 1/10

[52] U.S. Cl. ..... 62/347; 141/302; 222/450

[58] Field of Search ..... 222/185.1, 446–448, 222/450; 141/302; 62/347, 353

[56] References Cited

U.S. PATENT DOCUMENTS

| | | | |
|---|---|---|---|
| 2,602,576 | 7/1952 | Spruck | 222/450 X |
| 3,335,921 | 8/1967 | Gellatly | 222/450 X |
| 3,908,391 | 9/1975 | Wulke et al. | 62/353 X |
| 4,060,183 | 11/1977 | Puurunen | 222/450 X |
| 5,275,215 | 1/1994 | Derby | 222/450 X |

FOREIGN PATENT DOCUMENTS 3137473 6/1991 Japan .

*Primary Examiner*—William E. Tapolcai
*Attorney, Agent, or Firm*—Cushman, Darby & Cushman, LLP

[57] ABSTRACT

A water-supply device in an automatic ice maker including an ice tray supplied with water is provided above the ice tray. The water-supply includes a quantity container and a metered water-supply tank provided above the quantity container. The water in the water-supply tank is supplied to the quantity container to provide a predetermined quantity of water. After that, the predetermined quantity of water is supplied to the ice tray by gravity so that a pump is not required.

13 Claims, 9 Drawing Sheets

APPARATUS FOR WATER SUPPLY OF AUTOMATIC ICE MAKING APPARATUS

BACKGROUND OF THE INVENTION

1. Field of the Invention

The present invention relates to a water-supply device for use in an automatic ice maker which automatically provides ice cubes.

2. Description of Related Art

FIG. 10 shows the structure of a conventional water-supply device of an automatic ice maker of a household refrigerator. The water-supply device is contained in a refrigerating compartment 1, and supplies water need in a plastic water container 2 to an ice tray 5 contained in a freezing compartment 4 by a water-supply pump 3. A water-supply tank 6 is mounted on the water container 2 and can be installed and removed. The water container 2 is supplied with water from the water-supply tank 6 through a water-supply portion 8 having a water-supply valve 7. The water level in the water container 2 contains a quantity of water to always close a bottom opening portion of the water-supply portion 8.

A partition wall 10 partitions off a water-supply enclosure 11 and a quantity enclosure 12 in the water container 2. The water-supply portion 8 of the water-supply tank 6 projects into the water-supply enclosure 11. A pump 3*a* of the water-supply pump 3 projects into the quantity enclosure 12. When the water-supply pump 3 is driven, water in the quantity enclosure 12 is supplied to the ice tray 5. When the water level in the quantity enclosure 12 drops, there is a difference between the water level in the quantity enclosure 12 and the water level in the water-supply enclosure 11. The quantity enclosure 12 is supplied with a small water through a hole 9. Because the hole 9 passing between the enclosures 11 and 12 is very small. As a result while water is being supplied to the ice tray 5 from the quantity enclosure 12, only a very small quantity of water passes through hole 9 from water-supply enclosure 11. Therefore only the quantity of water in container 12 is supplied to the ice tray 5.

According to the conventional water-supply device described above, the water supply system is established on the premise that very little water is supplied to the quantity enclosure 12 through the hole 9 from water in the water-supply enclosure 11 while water is supplied the ice tray 5, because the hole 9 passing through the enclosure 11 and 12 is very small. However the hole 9 size could be different from a conventional size because of an aberration occurring during fabrication. As a result the quantity water is supplied from quantity enclosure 12 by driving water-supply pump 3 will not be correct amount when the conventional water is formed larger than the conventional size. Thus quantity supplying system will not provide in an adeguate degree of precision because water quantity supplied to the ice tray 5 can vary from product to product.

Also, the water container 2 can become dirty or moldy therein because there is water always impounded in the container 2. A noise from driving the water-supply pump 3 during the supply of water to the ice tray 5 may be annoying to a user.

SUMMARY OF THE INVENTION

Therefore, an object of the present invention is to provide a water-supply device for use in an automatic ice maker which can accurately supply a quantity of water without the above described problems and disadvantages.

To attain the aforementioned object of the invention, there is provided a water-supply device in an automatic ice maker having a quantity container positioned upper than the ice tray, the quantity container forming a water-exit portion at bottom portion of the quantity container, a water-supply tank positioned upper than the quantity container, a water-supply portion for supplying the quantity container with predetermined water, a water-exit valve mechanism for opening or closing the water-exit portion of the quantity container, a water-supply valve mechanism for opening or closing the water-supply portion, a valve-operate device, closed the water-exit valve mechanism so as to pour water in the water-supply tank into the quantity container, opened the water-supply valve mechanism for predetermined time, closed the water-supply valve mechanism after passing prior predetermined time and flowed out water in the quantity container, opened the water-exit valve mechanism, a water-supply member leaded water flowed out from quantity container at the ice tray.

Furthermore, to attain the aforementioned object of the invention, there is also provided a water-supply device in an automatic ice maker having a quantity container positioned upper than the ice tray, the quantity container forming a water-exit portion at bottom portion of the quantity container, a water-supply tank positioned upper than the quantity container, a water-supply portion formed at bottom position for supplying the quantity container with predetermined water, a water-exit valve mechanism having the first valve and the second valve for opening or closing the water-exit portion of the quantity container, the second valve is detouched from the water-exit portion when the water-exit portion is closed by the first valve, a water-supply valve mechanism for opening or closing the water-supply portion, a valve-operate device, the second valve is closed as the first valve is opened, which poured water in the water-supply tank into the quantity container accompanied with opened the water-supply valve mechanism for predetermined time, the water-supply valve mechanism is closed after passing predetermined time, which flowed out water which poured into the quantity container accompanied with opened the second valve, a water-supply member leaded water flowed out from the quantity container at the ice tray.

DESCRIPTION OF THE PREFERRED EMBODIMENTS

A first embodiment of the present invention will be described with reference to the accompanying drawings from FIG. 1 to FIG. 6. The first embodiment is directed to a water supply device for an automatic ice maker of a household refrigerator.

Figure 6:
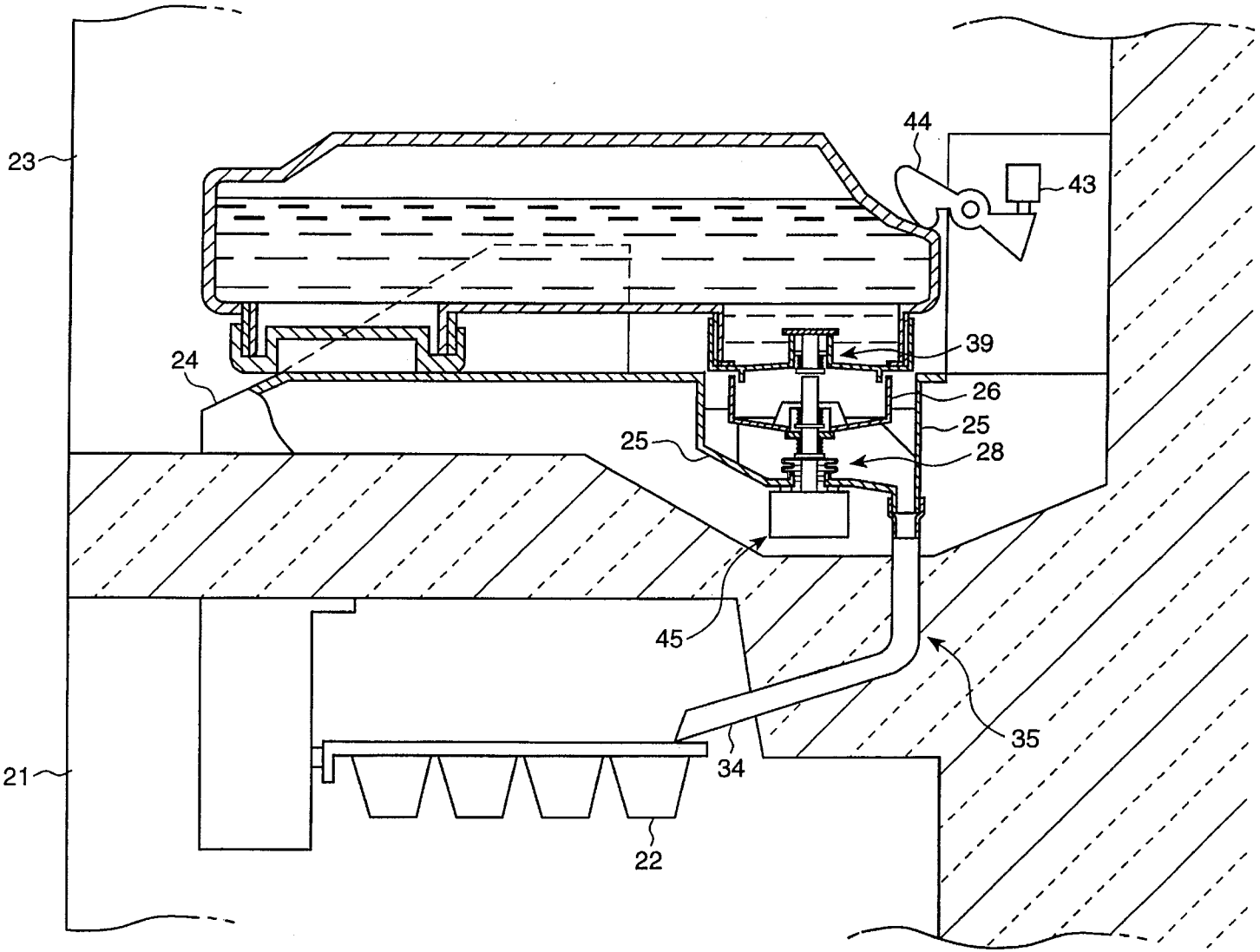
FIG. 6 is a longitudinal sectional side view of an automatic ice maker within a household refrigerator including the water-supply device of the first embodiment.

According to the structure shown in FIG. 6, a freezing compartment 21 of a household refrigerator is equipped with a plastic ice tray 22 which serves as an ice container. Water held in the ice tray 22 is frozen by cooling air supplied in the freezing compartment 21, and turns into ice. A plastic rest member 24 in a refrigerating compartment 23 is formed above the freezing compartment 21. The rest member 24 and a water-supply container 25 are formed as a single structure. Also with reference to FIG. 1, plural ribs 25*a* are formed configuous with the water-supply container 25. The upper portion of the ribs 25*a* form notched portions 25*b*. A metered quantity container 26 formed with a circular cross section is made from plastic and mounted in the water-supply container 25 on the notched portions 25*b* of the ribs 25*a*. As a result, the container 26 can be installed and removed.

A water exit portion 27 is formed in the center bottom of the quantity container 26. The water exit portion 27 is opened and closed by a water-outflow valve mechanism 28. The water-outflow valve mechanism 28 includes a shaft 29 which can be moved up and down. The shaft 29 is supported by plural ribs 26*a* formed on the bottom portion of the quantity container 26. A valve 30 is supported on and moves up and down with shaft 29, to open and close the water exit portion 27 on the outside of the quantity container 26. The shaft 29 is biased downward (as viewed in FIG. 1) by the force of a compression coil spring 31 which is positioned between a center flange 29*a* of the shaft 29 and ribs 26*a*. The valve 30 is compressed in the closed direction by force of a compression coil spring 32 positioned between the valve 30 and a bottom flange 29*b* of the shaft 29.

According to the above described structure, water held in the quantity container 26 flows out to the water-supply container 25 by opening the water exit portion 27. An outflow portion 33 is formed at the bottom portion of the water-supply container 25. The outflow portion 33 is connected to an upper inlet portion of a water-supply pipe 34 which has a lower outlet portion for directing water into the ice tray 22 (FIG. 6). The water-supply container 25 and water-supply pipe 34 provide a water-supply route 35 for supplying water from the outflow portion 33, from quantity container 26, to the ice tray 22.

Water-supply tank 36 is supported on the quantity container 26, and the rest member 24 so it can be installed and removed. A cylindrical portion 36*a* is formed at the bottom surface of the water-supply tank 36, in which a cap 37 is installed. A water-supply portion 38 includes a small diameter cylindrical portion 38*a* projecting upward and a low height large diameter cylindrical portion 38*b* projecting downward is mounted on the cap 37. The water-supply portion 38 is opened and closed by a water-supply valve mechanism 39, which includes a shaft 40 and a valve 41. The shaft 40 is supported by a support member 38*c* which is mounted in the water-supply portion 38, so that the shaft 40 can be moved up and down. The shaft 40 is installed to project upward within from water-supply portion 38. The valve 41 closes to the water-supply portion 38 with a downward force exerted by a compression coil spring 42 when no external force is applied to the shaft 40. The compression coil spring 42 is positioned between a bottom flange 40*a* of the shaft 40 and the support member 38*c*. The water-supply tank 36 is sealed against the outflow of water except during an opening operation of the water-supply portion 38.

The cylindrical portion 36*a* of the water-supply tank 36 is formed with a larger diameter than the upper surface of the quantity container 26. The cap 37 is mounted above an upper end 26*b* of the quantity container 26 with a clearance between a lower surface of cap 37 and the upper end 26*b* of container 26. The cap 37 serves as a cover portion of quantity container 26 to reduce a number of parts. The upper opening of the quantity container 26 is covered by the cap 37.

The large diameter cylindrical portion 38*b* of the water-supply portion 38 is formed with a smaller diameter than the inside of the quantity container 26, and is inserted in the quantity container 26 to form a gap with the inside of the quantity container 26. The shaft 40 of the water-supply valve mechanism 39 is positioned in a direction to be coaxial with the length of the shaft 29 of the water-outflow valve mechanism 28. With reference to FIG. 6, a switch 43 is provided for detecting the presence, through the lever 44, of the water-supply tank 36 mounted on the rest member 24.

Figure 4A:
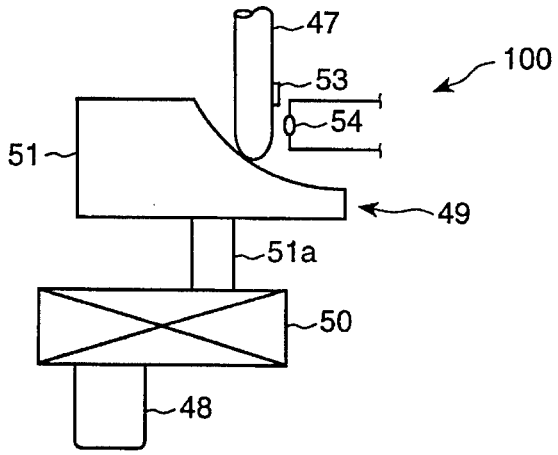
FIG. 4(*a*)–4(*c*) illustrate operation of a cam mechanism.
Figure 4B:
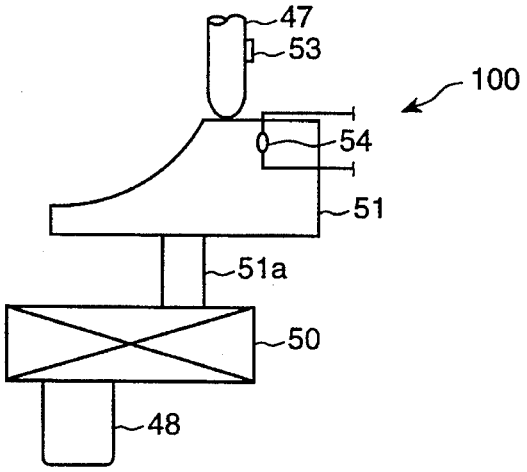
Figure 4C:
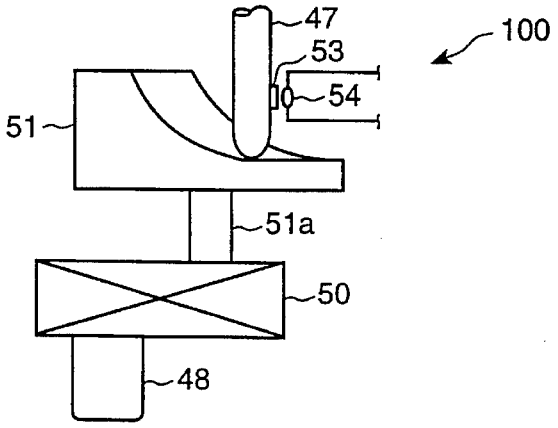

A valve-operate device 45 is mounted on the outside bottom portion of the water-supply container 25 for opening or closing the water-outflow valve mechanism 28 and water-supply valve mechanism 39. The device 45 includes an operating spindle 47 and a motor 48 (FIG. 4). The operating spindle 47 is supported in a case 46 so that spindle 47 can be moved up and down. As shown in FIGS. 4(*a*)–4(*c*), for example, a pulse-motor 48 is provided as a motor which is a driving source for driving the operating spindle 47. A reduction gear mechanism 49 is provided to change the rotation of the pulse-motor 48 into an up-down operation of the operating spindle 47. The reduction gear mechanism 49 includes a cam-axis 51*a* supporting a cam board 51. A cam-axis 51*a* is rotated by the pulse-motor 48 through a reduction mechanism 50. An upper surface such as a cam-surface of the cam board 51 is formed uneven. One ratation of the cam board 51 corresponds to a round trip of the operating spindle 47 during which the bottom end of the operating spindle 47 is in contact with the upper surface of the cam board 51.

Figure 1:
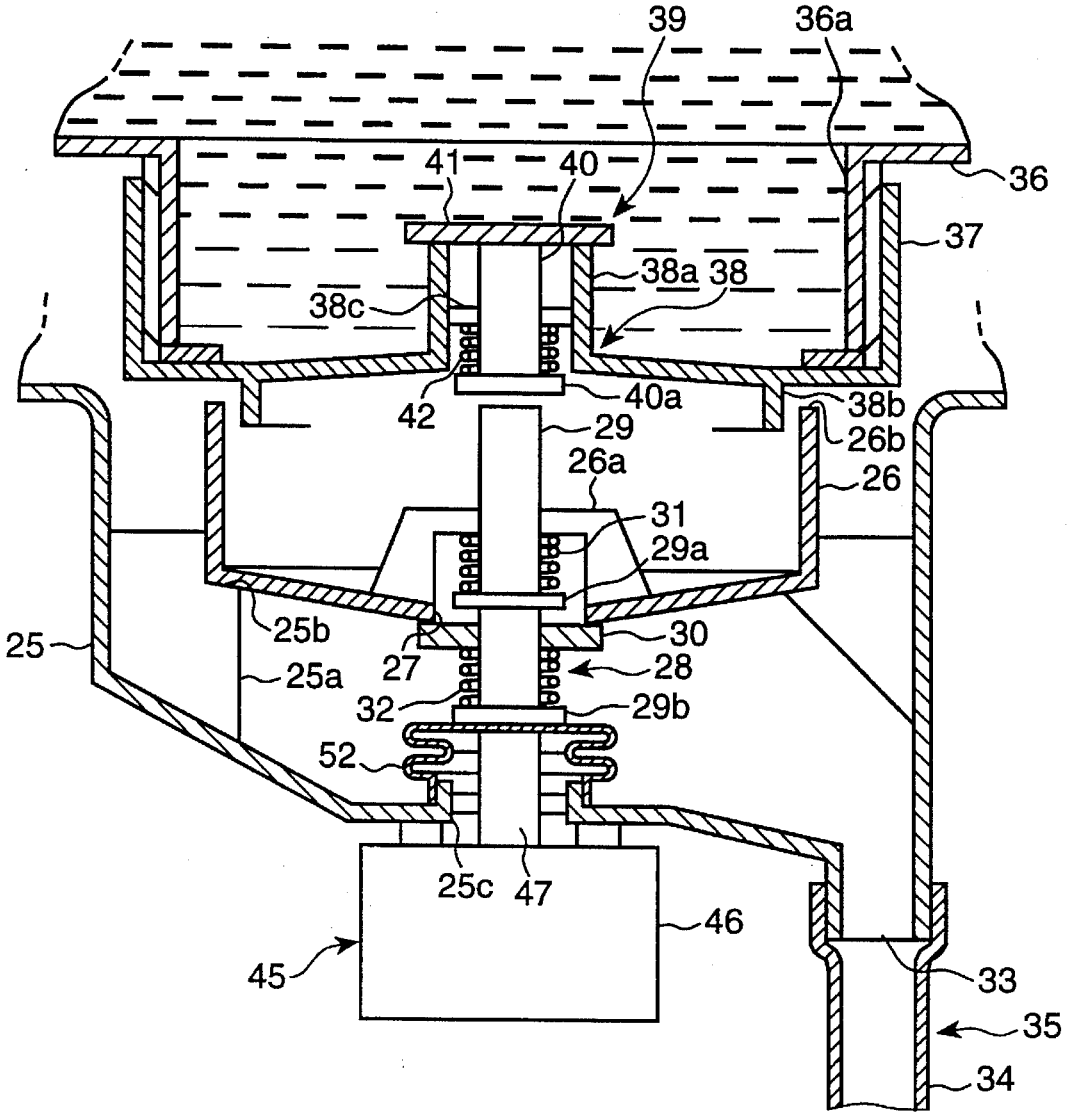
FIG. 1 is a longitudinal sectional side view of a water-supply device in an automatic ice maker in accordance with a first embodiment of the present invention.

As shown in FIG. 1, the operating spindle 47 passes through a hole 25*c* formed at the bottom portion of the water-supply container 25 and projects upward. The hole 25*c* is covered by a bellows 52 to prevent the flow of water out through hole 25*c*. The movement up and down of operating spindle 47 is accompanied by expansion and contraction of the bellows 52. The shaft 29 of water-outflow valve mechanism 28 is in contact with the operating spindle 47 through the bellows 52. The operating spindle 47 is normally in a stopped state at center position. In the center position, the shaft 29 of the water-outflow valve mechanism 28 is pushed up to a predetermined height from the lowest position by the operation spindle 47. Also in the center position, the upper end of the shaft 29 is spaced from the shaft 40 of the water-supply valve mechanism 39. According to the foregoing state, the valve 30 of the water-outflow valve mechanism 28 closes water exit portion 27 because it is maintained in contact with the bottom surface of the quantity container 26 by the force of the compression coil spring 32. The valve 41 of water-outflow valve mechanism 28 closes water-supply portion 38 because it is maintained in contact with the upper end of the small diameter cylindrical portion 38*a* by the force of the compression coil spring 42.

The water-outflow valve mechanism 28 and water-supply valve mechanism 39 are opened and closed in accordance with one rotation of the cam-board 51 (cam-axis 51*a*), and supplied the ice tray 22 with water. As is shown in the foregoing structure, the operating spindle 47 is normally stopped at the center position (FIG. 4(*a*)) relative to its possible up and down movement between a highest position (FIG. 4(*b*)) and a lowest position (FIG. 4(*c*)). A starting position for one round trip rotation of the operating spindle 47 is the center position. During one rotation, in a first process, the spindle 47 rises from the center position to the highest position. In a second process the spindle 47 moves down from the highest position to the lowest position. In a third process, the spindle 47 rises from the lowest position to the center position (the starting position) and stops.

Therefore, during the supply of water to the ice tray 22, it is necessary for the pulse-motor 48 to be switched off when the operating spindle 47 returns to the center position. In accordance with the foregoing structure, the pulse-motor 48 is supplied with one pulse per one cycle of alternating current power as an example to control. With reference to FIG. 4(*a*)–4(*c*) the pulse-motor 48 is equipped with a position detector 100 for detecting the position of the operating spindle 47. The position detector 100 includes a magnet 53 installed on the operating spindle 47 and a lead switch 54 movement on the side of the case 46. The lead switch 54 is switched on as the operating spindle 47 goes down from the highest position (position in FIG. 4(*b*)) to the lowest position (position in FIG. 4(*c*)), and transmits an ON signal. The ON signal is inputted to a control system not shown in the drawings and including a microcomputer.

The control system deactivates the pulse-motor 48 after a predetermined time passes from the ON signal being inputted from the lead switch 54. The control system detects the frequency of the alternating current power source to which the power source cord of the household refrigerator is connected, and uses the frequency of the detected alternating current power source to measure a predetermined time from the occurrence of the ON signal to the time the pulse-motor 48 is to be deactivated. According to the foregoing structure, a number of pulse from the lowest position to which the operating spindle 47 has gone down to the position at which the pulse-motor 48 is to be deactivated is controlled to be a predetermined a number of pulses, and the operating spindle 47 stops at the center position ((*a*) position in FIG. 4).

According to the control system described above, control of the pulse-motor 48 is more readily achieved because the lead switch 54 is not switched on by both operations in which the operating spindle 47 moves down to the center position from the highest position and in which the operating spindle 47 returns from the lowest position to center position.

The operation of the structure described above is explained next.

Figures 5A, 5B, 5C:
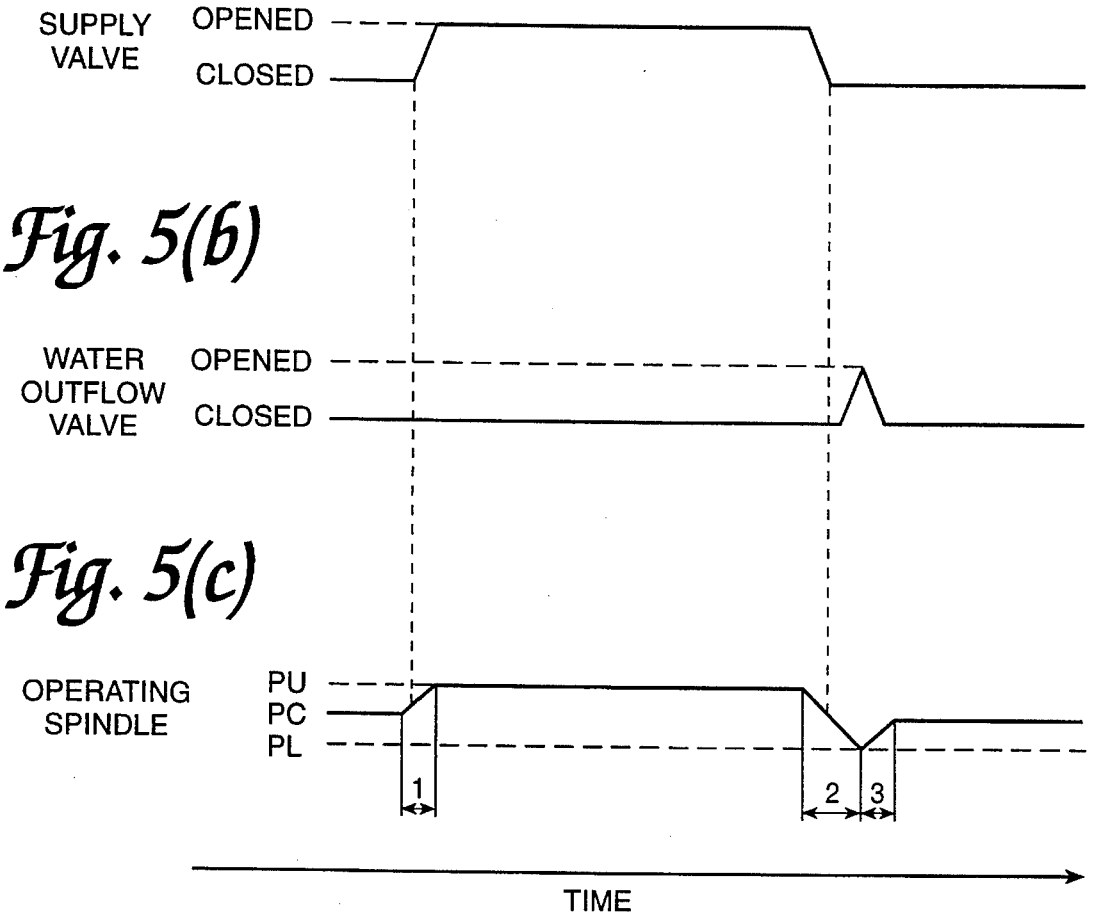
FIG. 5(*a*)–5(*c*) are timing charts which show a relationship between the open-close operations of a water-exit valve mechanism and a water-supply valve mechanism.

FIGS. 5(*a*)–5(*c*) show a relationship between the up-down movement of the operating spindle 47 and the open-close operations of the water-outflow valve mechanism 28 and water-supply supply valve mechanism 39. In FIGS. 5(*a*)–5(*c*), the center valve mechanism 39. In FIGS. 5(*a*)–5(*c*), the center position of the operating spindle 47 is designated PC, the highest position of the operating spindle 47 is designated PU, and the lowest position of the operating spindle 47 is designated PL.

The water exit portion 27 is closed by the valve 30 of the water-outflow valve mechanism 28 and the water-supply portion 38 is closed by the valve 41 of the water-supply valve mechanism 39 when the operating spindle 47 is at the center position PC. The shaft 29 of the water-outflow valve mechanism 28 is pushed up by the operating spindle 47 when the operating spindle 47 starts moving up from the center position to the highest position. Therefore, the valve 30 of the water-outflow valve mechanism 28 keeps the water exit portion 27 closed because the shaft 29 is pushed up by the compression coil springs 31 and 32. The shaft 29 is pushed up toward the closed position of valve 30. The valve 41 opens the water-supply portion 38 when the shaft 29 of the water-outflow valve mechanism 28 is pushed up to a predetermined height because the shaft 29 is contacts the shaft 40 of the water-supply valve mechanism 39 and pushes up on shaft 40 against the force of the compression coil spring 42.

The shaft 29 of the water-outflow valve mechanism 28 and the shaft 40 of the water-supply valve mechanism 39 are pushed down by force of the compression coil spring 31, 32, respectively and 42, and the valve 41 of the water-supply valve mechanism 39 closes the water-supply portion 38 when the operating spindle 47 shifts to the second process which moves down from the highest position PU to the lowest position PL. Therefore, in spite of the shaft 29 moving down, the valve 30 of the water-outflow valve mechanism 28 remains pressed against the bottom portion of the quantity container 26 and the water exit portion 27 is kept closed because of the force of the compression coil spring 32 in the upward direction.

Next, the valve 29 and the shaft 30 are moved down together because of a loss of force for compressing the valve 30 in the upward direction accompanied by stretching of the compression coil spring 32 until the limit of its compressive force, which results in separation of the bottom portion of the quantity container 26 and opening of the water exit portion 27.

In the third process, the operating spindle 47 rises from the lowest position to the center position after going down to the lowest position, so that the shaft 29 of water-outflow valve mechanism 28 rises compressing the compression coil spring 31. The compression coil spring 32 is compressed again when the shaft 29 pushed by the operating spindle 47 rises to a predetermined height. As a result, the valve 28 closes the water exit portion 27 by being pressed against the bottom portion of the quantity container 26 by the compressive force.

Figure 2:
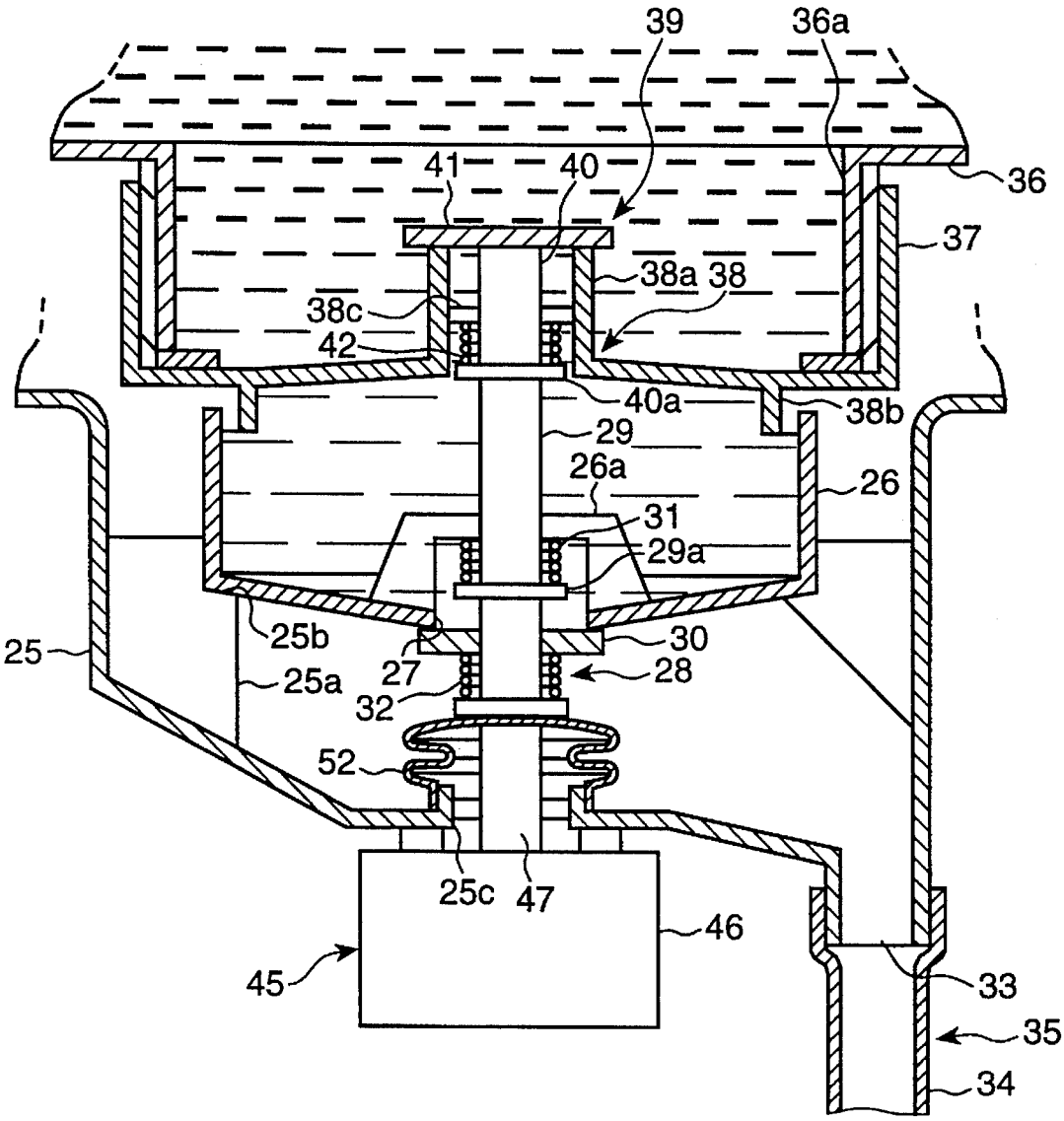
FIG. 2 corresponds to FIG. 1, and shows a view of supplying water to a metered quantity enclosure.

With respect to the complete process for making ice in the ice tray 22, the ice is dropped into a reserving box (not shown in drawings) because of turning of the ice tray. The ice tray is returned to an upright position after the ice is dropped in the reserving box. Then the pulse-motor 48 is turned on for supplying water to the ice tray 22. Thereupon, as shown in FIG. 2, the operating spindle 47 rises from the center position to the highest position (the first process). The first process is that the water-supply valve mechanism 39, is opened to open the water-supply portion 38 of the water-supply tank 36 held. The valve 30 of the water-outflow valve mechanism 28 is closed the maintain the water exit portion 27 of the quantity container 26 closed. Therefore, water in the water-supply tank 36 is held in the quantity container 26 as a result of the flowing out of the water to the quantity container 26 through the water-supply portion 38. As the water level in the quantity container 26 rises and a bottom opening portion such as the bottom end of the water-supply portion 38 is covered by the water-surface, during the flowing out of water from the water-supply portion 38 of the water-supply tank 36, the flowing out of water from the water-supply portion 38 is stopped. Then, as the large diameter cylindrical portion 38*b* is always supported at a predetermined position, the predetermined water level corresponding to a predetermined quantity is always collected in the quantity container 26.

With respect to the flow of water into the quantity container 26, water fills the inside area of the water-supply portion 38. The water filled within the inside area of the water-supply portion 38 and the water held in the quantity container 26 is supplied to the ice tray 22. However, it is necessary to exhaust the air inside the water-supply portion 38 to enable it to be completely filled with water. The foregoing operation is described below. With reference to the structure described above, in the first embodiment of the invention, since the bottom surface of the cap 37 is formed so as to slope in an upward direction toward the bottom opening portion, the bottom portion of the large diameter cylindrical portion 38*b* is covered by the water contained in the quantity container 26. The air inside of the large diameter cylindrical portion 38*b* flows along the side of the small diameter cylindrical portion 38*a* and along the slope of the cap's (37) bottom surface. The air enters the water-supply tank 36 via the inside of the small diameter cylindrical portion 38*a*. The quantity of water commensurate with the entering air flows into the large diameter cylindrical portion 38*b* from the water-supply tank 36. In consequence, the air does not stay in the large diameter cylindrical portion 38*b* or in the water-supply portion 38, and the inside of the water-supply portion 38 is completely filled with water.

Figure 3:
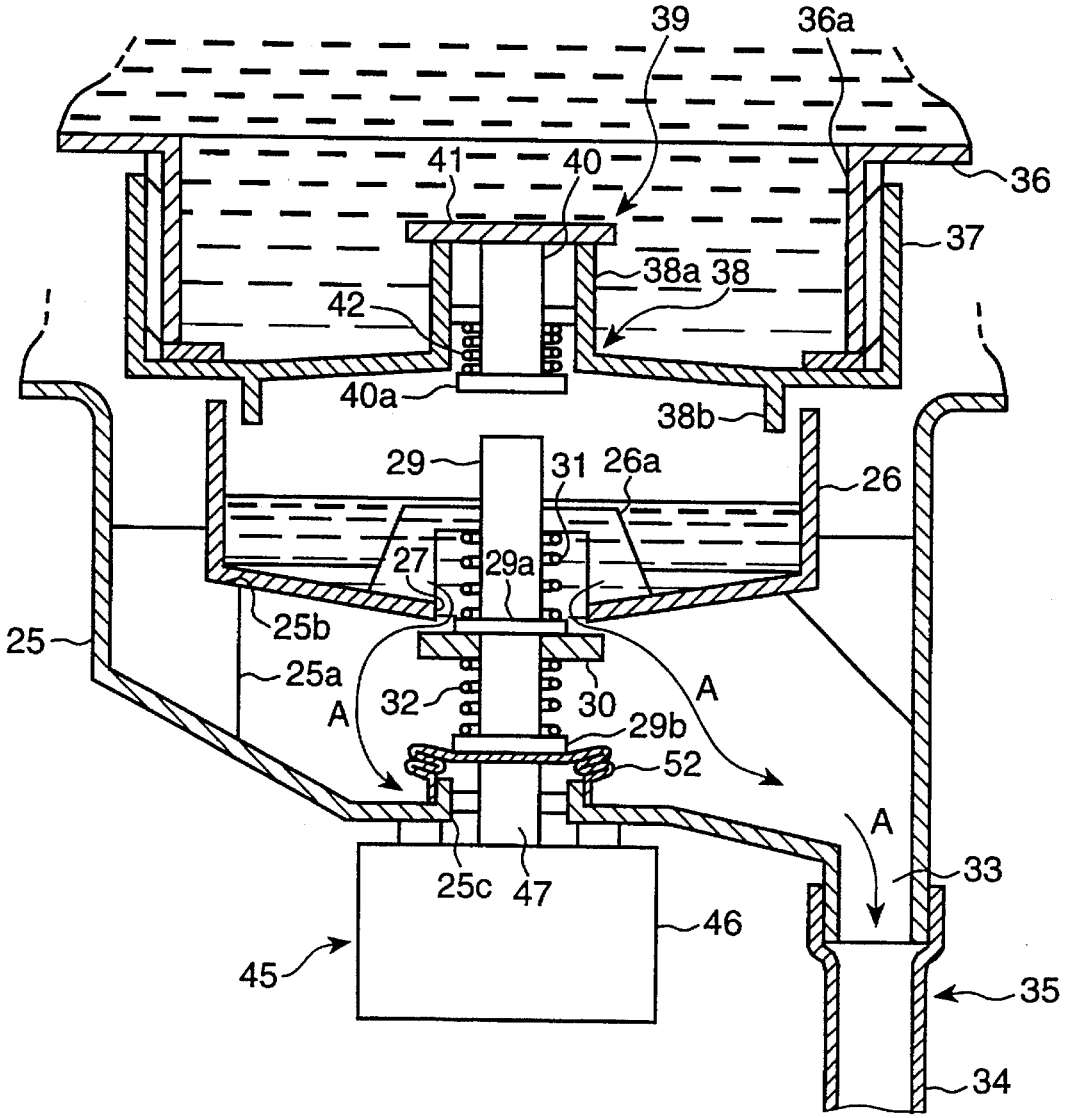
FIG. 3 corresponds to FIG. 1, and shows a view of supplying water to the ice tray from the quantity enclosure.

Thus, the inside of the water-supply portion 38 is filled with water together with the water contained in the quantity container 26. After that, the operation shifts to the second process, in which the operating spindle 47 moves down from the highest position PU to the lowest position PL. The water-supply portion 38 is closed by the valve 41 of the water-supply valve mechanism 39 accompanied with the operating spindle 47 moving down. After that, the valve 30 of the water-outflow valve mechanism 28 is moved away from the bottom portion of the quantity container 26 and the water exit portion 27 is opened. As shown in FIG. 3, water held in the quantity container 26 and water inside the cylindrical portion of water-supply portion 38 of the water-supply tank 36 which communicates with the container 26, flows out to the water-supply container 25 from the water exit portion 27, and is supplied to the ice tray 22 through the water-supply pipe 34 from the outflow portion 33 due to a difference in height between the container 25 and the ice tray 22.

The foregoing operation shifts to the third process in which the operating spindle 47 returns to the center position from the lowest position. The valve of the water-outflow valve mechanism 28 closes the water exit portion 27 when the shaft 29 of the water-outflow valve mechanism 28 is pushed up the predetermined height by the operating spindle 47. Then, the supplying of the ice tray 22 with water is completed, after that the operating spindle 47 rises to the center position PC and stops at the foregoing position shown in FIG. 1, and keeps closed the water exit portion 27.

Similar to the operation described above, cooling air flowing in the freezing compartment 23 turns water supplied to the ice tray 22 into ice and ice is stored in the reserving box when dropped from the ice tray 22 due to its being turned. Upon returning the ice tray 22 to the former, up right position, the pulse-motor 48 is energized again and the operation described above is repeated.

Figure 10:
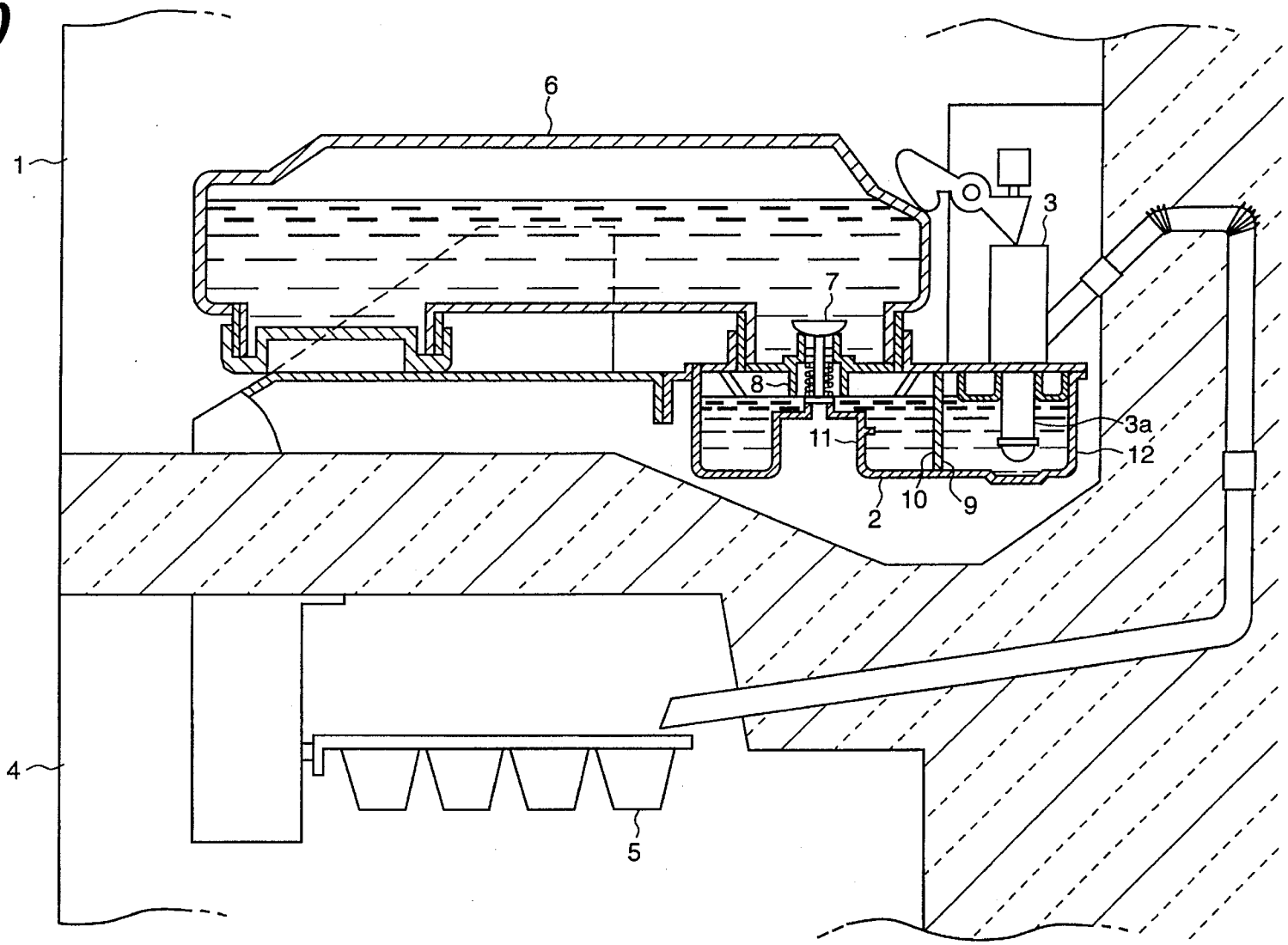
Fig. 10 (PRIOR ART)
FIG. 10 is a longitudinal sectional side view of a conventional automatic ice maker.

Thus, according to the first embodiment of invention, the quantity of water held in the quantity container 26 is supplied to the ice tray 22. The quantity container 26 also includes water inside of the water-supply portion 38. Thus, the conventional structure shown in FIG. 10 is different from the invention. In contrast to the conventional structure, since there is no risk of flowing water into the quantity container 26 from other portions of the device during supplying water to the ice tray 5, the correct quantity of water is always supplied with the ice tray 5 and the supplied quantity of water is supplied with precision. Furthermore, as water in the quantity container 26 is supplied to the ice tray 22 by the difference in height there between, the operation of supplying water can be carried out without generation of noise. In this case, using a motor (e.g.) pulse-motor 48) to drive the valve-operate device 45 is more effective to quietly supply water.

Additionally, in the first embodiment of the invention, the quantity container 26 is normally empty, and water is only held in the quantity container 26 during the above described process for filling the ice cube tray 22. Therefore it is difficult for the quantity container 26 to become dirty or moldy. The smell of foods contained in the refrigerating compartment 23 is not absorbed. As the quantity container 26 is able to be installed and dismantled, the quantity container 26 easily can be cleaned by washing with water after dismantling from the water-supply container 25 on the occasion of becoming dirty from prolonged use. Thus the foregoing operation is convenient.

Also, in the first embodiment of the invention, as the bottom face of the cap 37 is sloped so as to be inclined, air in the large diameter cylindrical portion 38*b* of the water-supply portion 38 does not remain as bubbles. Therefore, the quantity of water supplied to the ice tray 22 is more precise than in the conventional structure. The diameter of the large diameter cylindrical portion 38*b* is formed a little smaller than the inside diameter of the quantity container 26 so as to form a gap between the outside surface of the large diameter cylindrical portion 38*b* and the inside surface of the quantity container 26. Therefore, if the a household refrigerator is positioned on a slope, the surface of water contained in the quantity container 26 also slopes. However as the gap is small, the water quantity change accompanied with the slope of the water surface is small.

Additionally the water-supply valve mechanism 39 is opened in the first process in which the operating spindle 47 rises from the center position PC to the highest position. The water-supply valve mechanism 39 is closed and the water-outflow valve mechanism 28 is opened in the second process in which the operating spindle 47 moves down from the highest position to the lowest position. The water-outflow valve mechanism 28 is closed in the third process in which the operating spindle 47 rises from the lowest position to the center position. The water-supply valve mechanism 39 and the water-outflow valve mechanism 28 are normally maintained to be in a closed condition. Thus, for example, water is held in the water-supply container 25 on the occasion of a water leak from the gap between the outside of the cylindrical portion 36*a* and the inside of the cap 37 because the fastening force of the cap 37 threaded to the cylindrical portion 36*a* with the water-supply tank 36 is not tight. Therefore, the foregoing operation stops the overflow of water due to leaking from the water-supply tank 36. Water contained in the quantity container 26 including water due to leakage from the water-supply tank 36 is supplied with the ice tray 22 at the next water-supply time. The water-outflow valve mechanism 28 can have a lower cost since it is only equipped with one valve 30.

Figure 8:
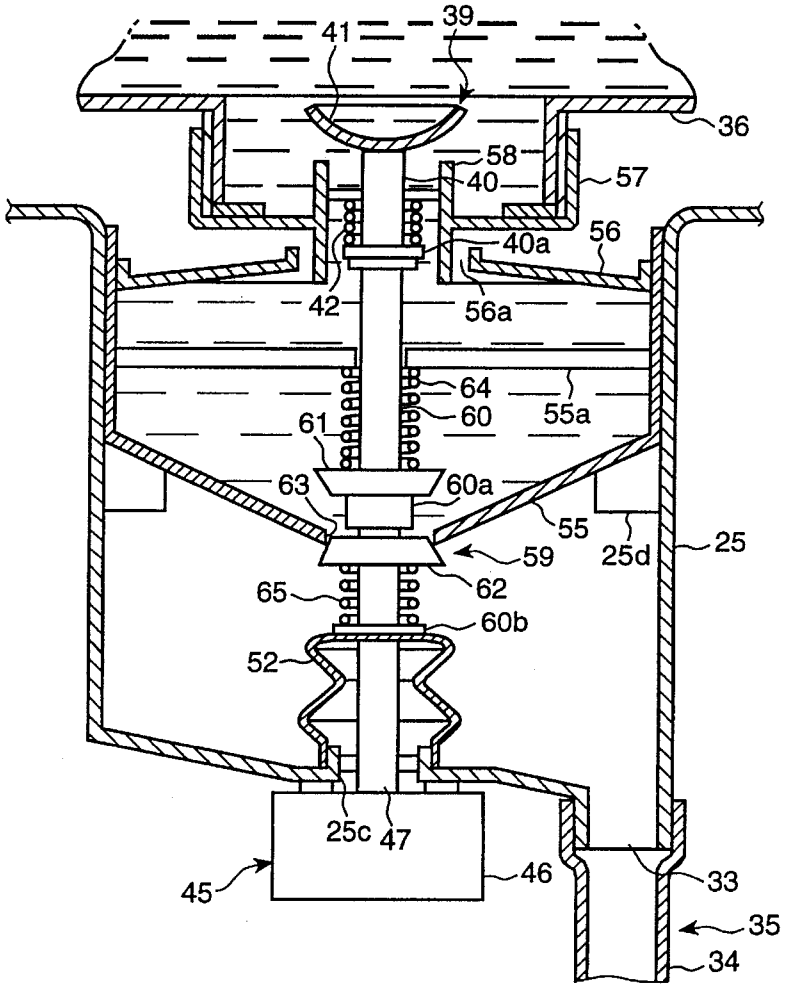
FIG. 8 corresponds to FIG. 7, and shows a view of supplying water to a metered container.
Figure 7:
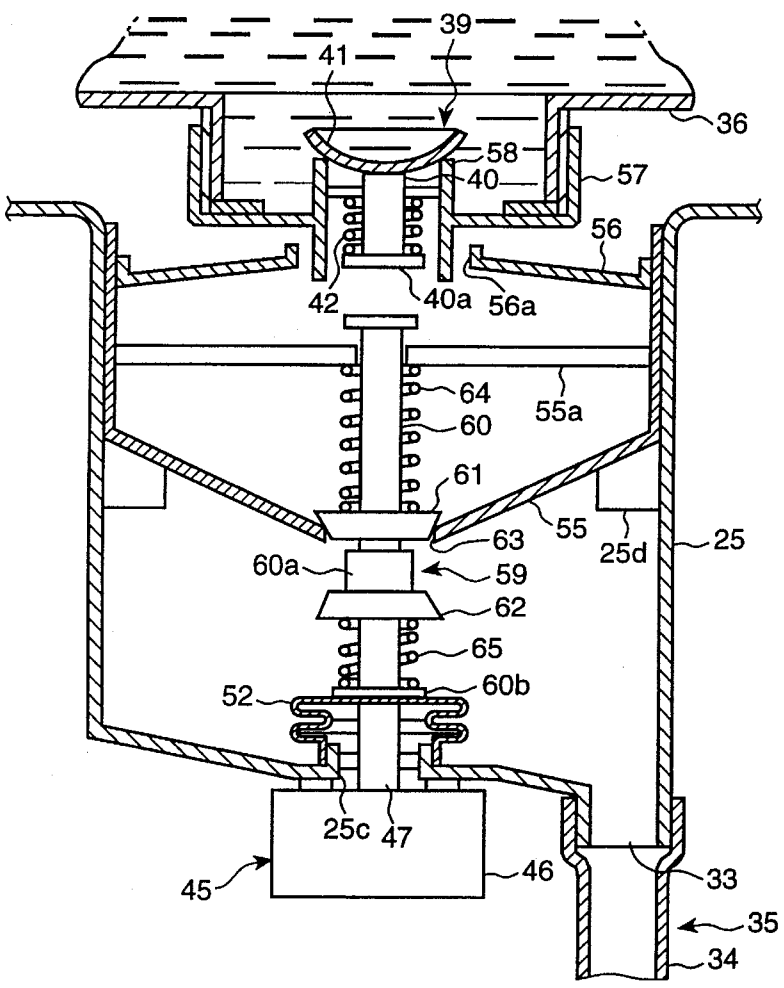
FIG. 7 is a longitudinal sectional side view of a water-supply device in an automatic ice maker, in accordance with a second embodiment of the present invention.
Figure 9:
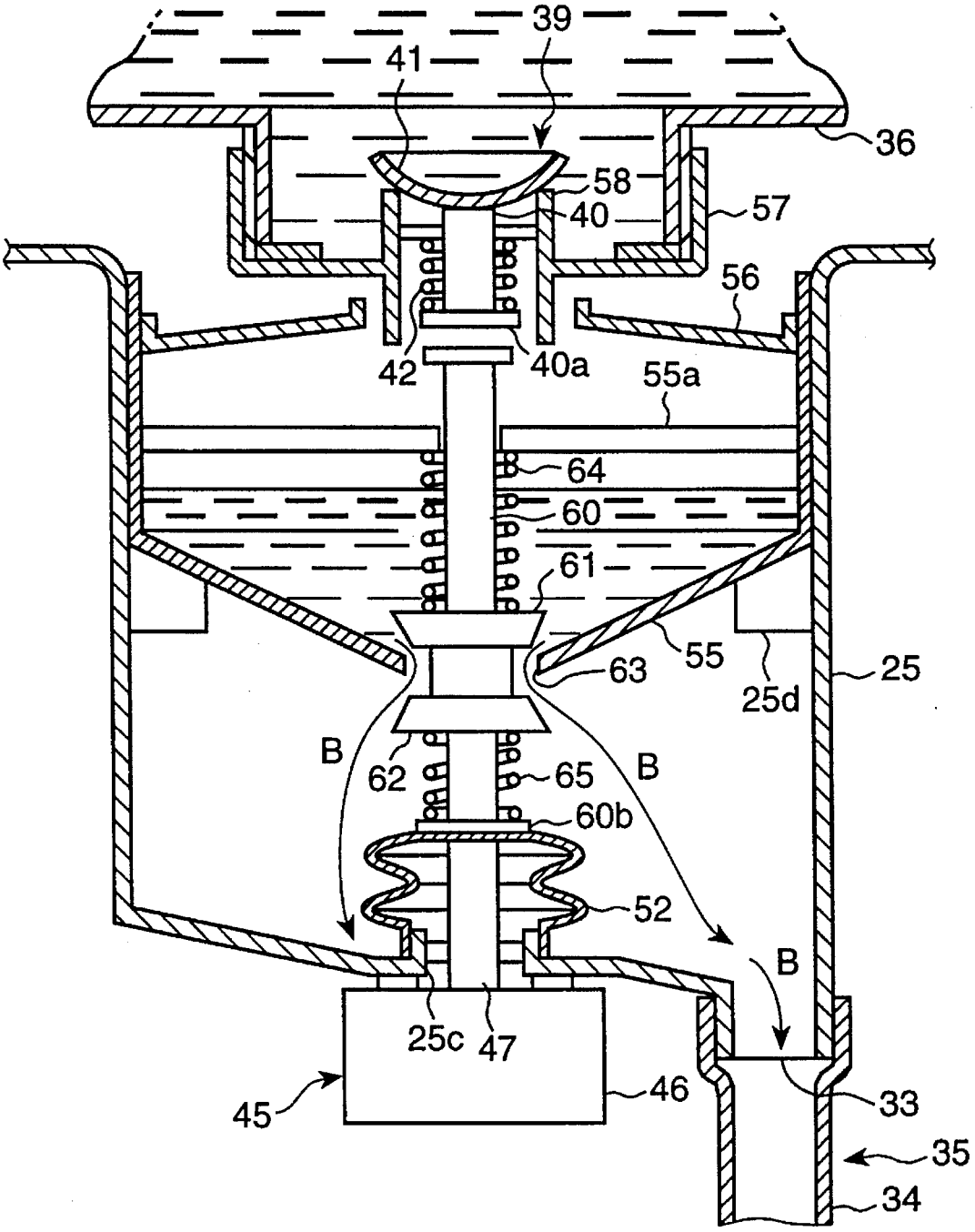
FIG. 9 corresponds to FIG. 7, and shows a view of supplying water to the ice tray from the quantity container.

A second embodiment of the invention is shown in FIG. 7, FIG. 8, and FIG. 9. Elements common to the first embodiment are identified with the same reference numerals. The structure described below primarily represents differences from the first embodiment.

A cover 56 such as a lid includes a metered quantity container 55 which can be installed and dismantled so as to mount on ribs 25*d* formed configuous with the water-supply container 25. The cover 56 is formed to be inclined so as to slope in an upward, direction toward a center opening portion 56*a*. A cap 57 of the water-supply tank 36 is provided and includes, a water-supply portion 58 formed as a small diameter cylindrical portion projecting from both an upper side and a lower side of the bottom of cap 57. A bottom end portion of the water-supply portion 58 is inserted in the quantity container 55 through the opening portion 56*a* of the cover 56.

A support member 55*a* is formed inside of the quantitaitive container 55. A shaft 60 of a water-outflow valve mechanism 59 is supported by the support member 55*a* to enable up and down movement. A first 61 valve and a second valve 62 are respectively positioned above and below a large diameter portion 60*a* and are mounted on the shaft 60 to be slidable thereon. The large diameter portion 60*a* is fixed to the shaft 60. The first valve 61 opens and closes the water-outflow portion 63 from inside of the quantity container 55. The second valve 62 opens and closes the water-outflow portion 63 from outside of the quantity container 55.

The first valve 61 is forced downward by the force of a compression coil spring 64 positioned between the first valve 61 and the support member 55*a*. The second valve 62 is forced upward by the force of a compression coil spring 65 positioned between the second valve 62 and a bottom flange 60*b* of the shaft 60. The operating spindle 47 of the valve-operate device 45 is normally positioned at the lowest position PL. To supply water to the ice tray 22, the operating spindle 47 rises then from the lowest position PL to the highest position PU and from the highest position PU to the lowest position PL. The pulse-motor 48 of the valve-operate device 45 is controlled so as to be deactivated when the operating spindle 47 has returned to the lowest position. The magnet 53 and the lead switch (54) can be appropriately positioned to facilitate control of the pulse-motor 48 of the valve-operate device 45 to supply water to the ice tray 22.

When the operating spindle 47 is positioned at the lowest position PL, as shown in FIG. 7, the first valve 61 closes the water exit portion 63 by force of the compression coil spring 64 pushing the first valve 61 against the bottom portion of the quantity container 55. At this time, the second valve 62 is open on the water exit portion 63 and the force of the compression coil spring 65 is stopped by contact of the second valve 62 with the large diameter portion 60*a*.

The shaft 60 of the water-outflow valve mechanism 59 is pushed up when the operating spindle 47 rises from the lowest position PL during times of supplying the ice tray 22. As shown in FIG. 8, the shaft 60 rises with the large diameter portion 60*a* against the force of the compression coil spring 64 while the large diameter portion 60*a* contacts the first valve 61 due to this movement. Therefore, the first valve 61 is lifted from the bottom portion of the quantity container 55, and the water exit portion 63 is opened. Next, as the second valve 62 contacts the bottom portion of the quantity container 55 and stops, the second valve 62 closes the water exit portion 63 by force of the compression coil spring 65 pushing the second valve 62 against the bottom portion of the quantity container 55.

After that, the valve 41 of the water-supply portion 58 is opened due to the rising shaft 60 contacting and pushing up the shaft 40 of the water-supply valve mechanism 39. Therefore, water in the water-supply tank 36 flows out in to the quantity container 55 from the water-supply portion 58. The flowing out of water from the water-supply tank 36 is stopped when the bottom end of the water-supply portion 58 is covered by water which accumulates in the quantity container 55 due to the flowing out of the water stored in the water-supply tank 36 in to the quantity container 55 through the water-supply portion 58. Therefore, the predetermined amount of the water is held in the quantity container 55, and inside of the water-supply portion 58 is filled with water. When water flows into the quantity container 55, the air in the quantity container 55 smoothly exits through the opening portion 56*a* because the cover 56 is formed so as to be inclined.

In the structure described above, with the predetermined quantity of water contained in the quantity container 55, the operating spindle 47 moves down toward the lowest position from the highest position. Therefore, the shaft 40 of the water-supply valve mechanism 39 is pushed down by the force of the compression coil spring 42, and the valve 41 closes the water-supply portion 58. Accompanied with the downward movement of the operating spindle 47 after the valve 41 is closed, as shown in FIG. 9, water held in the quantity container 55 and water in the water-supply portion 58 is supplied to the ice tray 22 through the water-supply pipe 34 after flowing through the water-supply container 25 as shown by the arrows B because the large diameter portion 60*a* on the shaft 60 of the water-outflow valve mechanism 59 contacts the second valve 62 and the second valve 62 moves downward with the portion 60*a*.

After that, as the first valve 61 contacts the bottom portion of the quantity container 55 and stops, the first valve 61 closes the water exit portion 63 by force of the compression coil spring 64 which pushes down against the bottom portion of the quantity container 55. The operating spindle 47 stops at the lowest position PL, and the water exit portion 63 remains closed by the water-outflow valve mechanism 59.

The structure described above is as effective as that of the first embodiment. Additionally, the control system for stopping the pulse-motor 48 can readily be provided since it is only necessary to deactivate the pulse-motor 48 during the supplying of the ice tray 22 with water when the lead switch 54 turns on to indicate that the operating spindle 47 has moved down to the lowest position PL.

The first embodiment of the invention can be operated effectively even if valve 30 of the water exit portion of the quantity container remains open after tray filling is complete.

The reduction gear mechanism disclosed above is a means to change a rotating movement into a linear movement. The reduction gear mechanism means can also be provided as a screw mechanism or a crank mechanism.

The driving source of the valve-operate device 45 can also be provided as an electromagnet to move and support the operating spindle 47 at the PU, PC, and PL positions.

Additional advantages and modifications will readily occur to those skilled in the art. The invention in its broader aspects is therefore not limited to the specific details, representative apparatus and method, and illustrative examples shown and described. Accordingly, departures may be made from such details without departing from the spirit or scope of the general inventive concept. Thus, it is intended that this invention cover the modifications and variations of the invention provided they are within the scope of the appended claims and their equivalents.

What is claimed is:

1. A water supply device in an automatic ice maker for supplying an ice tray with water, the water supply device comprising:

a metered quantity container positioned above the ice tray and including a first water exit portion at a bottom portion of the quantity container;

a water supply tank positioned above the quantity container and including a second water exit portion for supplying water from the water supply tank to the quantity container;

a water exit valve mechanism for opening and closing the first water exit portion of the quantity container;

a water supply mechanism for opening and closing the second water exit portion of the water supply tank;

a valve operator device for controlling the water supply and water exit valve mechanisms so that, as a first process, the water supply and water exit valve mechanisms are respectively open and closed, as a second process, the water supply and water exit valve mechanisms are respectively closed and open, as a third process, the water supply and water exit valve mechanisms are both closed; and a water supply member to direct water flowing from the first exit portion to the ice tray.

2. The water supply device of claim 1 wherein the valve operator device comprises an operating portion which communicates with the water exit and water supply valve mechanisms and is movable from center to upper positions, from upper to lower positions and from lower to center positions for the first, second, and third processes, respectively.

3. The water supply device of claim 1 wherein the valve operator device controls the water exit valve mechanism initially to be closed.

4. The water supply device of claim 1 wherein the water flows in the water supply member because of gravity.

5. The water supply device of claim 1 wherein the valve operator device is operated to perform in sequence the first, second, and third processes.

6. A water supply device in an automatic ice maker for supplying an ice tray with water, the water supply device comprising:

a metered quantity container positioned above the ice tray and including a first water exit portion at a bottom of the quantity container;

a water supply tank positioned above the quantity container and including a second water exit portion for supplying water from the water supply tank to the quantity container;

a water exit valve mechanism having a first valve and a second valve each for opening and closing the first water exit portion of the quantity container, the second valve being out of contact with the first water exit portion when the first water exit portion is closed by the first valve;

a water supply valve mechanism for opening and closing the second water exit portion of the water supply tank;

a valve operator device for controlling the water supply and water exit valve mechanisms so that, as a first process, the water supply valve mechanism and the second valve are respectively open and closed, as a second process the water supply valve mechanism is closed and the first and second valves are open and, as a third process, the water supply valve mechanism and the first valve are closed;

a water supply member to direct water flowing from the first water exit portion to the ice tray.

7. The water supply device of claim 6 wherein the valve operator device comprises an operating portion which communicates with the water exit and water supply valve mechanisms and is movable between upper and lower positions.

8. The water supply device of claim 6 wherein the water flows in the water supply member because of gravity.

9. The water supply device of claim 6 wherein the valve operator device is operated to perform in sequence the first, second, and third processes.

10. The water supply device of claims 1 or 6 wherein the valve operator device is driven by a motor.

11. The water supply device of claims 1 or 6 wherein the quantity container is removably mounted in the water supply device.

12. The water supply device of claims 1 or 6 wherein a bottom surface of the water supply tank covers an upper portion of the quantity container.

13. The water supply device of claims 1 or 6 wherein the bottom surface of the water supply tank is sloped upward toward a central region.

* * * * *